US009725873B2

(12) United States Patent
Cormier et al.

(10) Patent No.: US 9,725,873 B2
(45) Date of Patent: Aug. 8, 2017

(54) SECONDARY CONTAINMENT SYSTEM

(71) Applicants: Timothy J. Cormier, Cincinnati, OH (US); Darrell J. Sanders, Mason, OH (US)

(72) Inventors: Timothy J. Cormier, Cincinnati, OH (US); Darrell J. Sanders, Mason, OH (US)

(73) Assignee: CONTECH ENGINEERED SOLUTIONS LLC, West Chester, OH (US)

( * ) Notice: Subject to any disclaimer, the term of this patent is extended or adjusted under 35 U.S.C. 154(b) by 365 days.

(21) Appl. No.: 14/527,864

(22) Filed: Oct. 30, 2014

(65) Prior Publication Data

US 2015/0129823 A1 May 14, 2015

Related U.S. Application Data

(60) Provisional application No. 61/902,949, filed on Nov. 12, 2013.

(51) Int. Cl.
*E02D 31/00* (2006.01)
*E04H 17/16* (2006.01)

(52) U.S. Cl.
CPC ..... *E02D 31/002* (2013.01); *E04H 17/168* (2013.01)

(58) Field of Classification Search
CPC ..... E04H 4/0043; E04H 4/005; E04H 17/16; E04H 17/168; E04H 17/18; E02D 27/01; E02D 27/38; E02D 31/00; E02D 31/002; B65D 90/24; B65D 90/08; B65D 90/027; B65D 90/023; E21B 21/01; E04B 2/74; E04B 2/7854; E04B 2002/7461; E02B 3/106
See application file for complete search history.

(56) References Cited

U.S. PATENT DOCUMENTS

| | | | | |
|---|---|---|---|---|
| 3,256,532 A | | 6/1966 | Lindsey et al. | |
| 3,302,412 A | | 2/1967 | Hunsucker | |
| 3,335,430 A | | 8/1967 | Schwarz et al. | |
| 3,444,659 A | | 5/1969 | Shanni | |
| 3,466,676 A | | 9/1969 | Barrera | |
| 3,511,004 A | * | 5/1970 | Snellings | E04B 1/6158 29/433 |
| 3,654,640 A | | 4/1972 | Katzman | |

(Continued)

FOREIGN PATENT DOCUMENTS

CA 2362105 A1 11/2001

*Primary Examiner* — Matthieu F Setliff
(74) *Attorney, Agent, or Firm* — Thompson Hine LLP

(57) ABSTRACT

A containment system including a wall member with a plurality of corrugations, each corrugation extending horizontally along a length of the wall member. Each of a multiplicity of the corrugations has openings therein, and at least some of the openings in the corrugations at least partially align to form an upright keyway through the wall member. The system further includes a bracket that has a plurality of corrugation-receiving spaces therein. The wall member is positioned with corrugations in respective corrugation-receiving spaces. The system also includes a locking member received in the upright keyway of the wall member and positioned such that interaction between the locking member and portions of the bracket prevent the wall member from being pulled away from the bracket.

17 Claims, 17 Drawing Sheets

(56) References Cited

U.S. PATENT DOCUMENTS

| | | | | |
|---|---|---|---|---|
| 4,020,509 | A | 5/1977 | West | |
| 4,124,907 | A | 11/1978 | Laven | |
| 4,137,576 | A | 2/1979 | Greene | |
| 4,407,612 | A | 10/1983 | Van Weele | |
| 4,562,603 | A | 1/1986 | Paradis | |
| RE32,181 | E | 6/1986 | Glonek et al. | |
| 4,917,543 | A | 4/1990 | Cole | |
| 4,960,222 | A | 10/1990 | Fields | |
| 5,002,195 | A | 3/1991 | Lasson | |
| 5,106,233 | A | 4/1992 | Breaux | |
| 5,154,312 | A | 10/1992 | Robbins | |
| 5,209,603 | A | 5/1993 | Morgan | |
| 5,282,546 | A | 2/1994 | Bauer | |
| 5,360,293 | A | 11/1994 | Breaux | |
| 5,524,781 | A | 6/1996 | Podd | |
| 6,053,666 | A | 4/2000 | Irvine | |
| 6,532,707 | B1 * | 3/2003 | Ian Cannon ..... | A01G 1/08 312/111 |
| 7,984,519 | B1 | 7/2011 | Hall | |
| 8,074,406 | B2 | 12/2011 | Ksenych et al. | |
| 2005/0091934 | A1 | 5/2005 | Kantor | |
| 2006/0107605 | A1 | 5/2006 | Krahn | |
| 2013/0233851 | A1 | 9/2013 | Thiessen | |

* cited by examiner

SECONDARY CONTAINMENT SYSTEM

TECHNICAL FIELD

The present application relates to enclosure systems. More particularly, the present application relates to secondary containment systems for creating spill barriers around storage tanks and the like.

BACKGROUND

Secondary containment systems are enclosures designed to create a perimeter around liquid storage tanks and the like as a safety mechanism to sequester liquid in the event of a spill and prevent contamination of the surrounding environment. These systems generally consist of a system of walls (often formed of corrugated metal plate) that are situated around the storage tanks and bolted together. The systems also commonly include support structures such as posts and/or anchor mechanisms that penetrate into the underlying ground to secure the positioning of the walls.

The assembly processes for many existing secondary containment systems are extremely labor intensive. For example, a foundation must often be established with holes excavated to facilitate the secure placement of the support structures into the surrounding earth. Then, to secure the wall pieces to the support structures and/or to each other, a large number of bolts are generally used, each of which must be painstakingly tightened while maintaining alignment of prefabricated holes in the pieces to be joined. Often, pairs of bolts are placed at each corrugation along a joint between two corrugated wall members, which can result in the use of twenty or more bolts at each connection point. Consequently, the existing secondary containment systems may require hundreds or thousands of bolts.

Advancements in manufacturability, cost and effectiveness of secondary containment systems continue to be sought.

SUMMARY

In one aspect, a containment system is disclosed, the containment system including a wall member with a plurality of corrugations, each corrugation extending horizontally along a length of the wall member. Each of a multiplicity of the corrugations has openings therein, and at least some of the openings in the corrugations at least partially align to form an upright keyway through the wall member. The system further includes a bracket that has a plurality of corrugation-receiving spaces therein. The wall member is positioned with corrugations in respective corrugation-receiving spaces. The system also includes a locking member received in the upright keyway of the wall member and positioned such that interaction between the locking member and portions of the bracket prevent the wall member from being pulled away from the bracket.

In accordance with another aspect, a containment system includes a corner joint. The corner joint has a first wall member with a plurality of first corrugations, each first corrugation extending horizontally along a length of the first wall member, where each of a multiplicity of the first corrugations having openings therein, and at least some of the openings in the first corrugations at least partially align to form an upright keyway through the first wall member. The system includes a second wall member with a plurality of second corrugations, each second corrugation extending horizontally along a length of the second wall member, where each of a multiplicity of the second corrugations having openings therein, and at least some of the openings in the second corrugations at least partially align to form an upright keyway through the second wall member. A corner member is included with a vertical corner seam, the vertical corner seam defining first and second portions of the corner member set at an angle relative to each other. The first and second portions of the corner member each having a plurality of corner corrugations, each corner corrugation extending horizontally along a length of the respective portion of the corner member. The corner corrugations have openings therein, and at least some of the openings in the corner corrugations at least partially align to form upright keyways through the corner member portions. The first and second portions of the corner member each include at least one keyway. The system further includes a first bracket with a first plurality of corrugation-receiving spaces therein. The first wall member is positioned with the first corrugations in the first plurality of corrugation-receiving spaces and the first portion of the corner member is positioned with the corner corrugations in the first plurality of corrugation-receiving spaces. A first pair of locking members is received in the upright keyways of the first wall member and the first portion of the corner member. The first pair of locking members is positioned such that interaction between the first pair of locking members and portions of the first bracket prevent the first wall member and the first portion of the corner member from being pulled away from the first bracket. The system has a second bracket with a second plurality of corrugation-receiving spaces therein. The second wall member is positioned with the second corrugations in the second plurality of corrugation-receiving spaces and the second portion of the corner member positioned with the corner corrugations in the second plurality of corrugation-receiving spaces. A second pair of locking members is received in the upright keyways of the second wall member and the second portion of the corner member. The second pair of locking members is positioned such that interaction between the second pair of locking members and portions of the second bracket prevent the second wall member and the second portion of the corner member from being pulled away from the second bracket.

In yet another aspect, a method for assembling a containment system is disclosed. The method involves providing a wall member including a plurality of corrugations, each corrugation extending horizontally along a length of the wall member, where each of a multiplicity of the corrugations have at least one opening therein. At least some of the openings in the corrugations at least partially align to form an upright keyway through the wall member. The method further includes positioning the wall member within a bracket, the bracket having a plurality of corrugation-receiving spaces therein, the corrugations of the wall member being received in the corrugation-receiving spaces. The method also involves inserting a locking member through the upright keyway of the wall member and positioning the locking member such that the wall member is secured to the bracket.

In a further aspect, a containment system includes a plurality of elongated corrugated wall members, each having corrugations extending laterally along a length of the wall member. The plurality of wall members are assembled into a containment boundary utilizing a plurality of brackets, each bracket having a plurality of corrugation-receiving spaces therein with at least one wall member of the plurality positioned with its corrugations in the corrugation-receiving spaces of the bracket and held in place relative to the bracket by an elongated locking key that is inserted through a keyway formed in the corrugations of the wall member.

In one implementation of the foregoing aspect, each bracket includes first and second panels, each panel including a lower base portion. A plurality of base pad members are provided, with a multiplicity of the brackets each being seated on a base surface of a respective base pad member. The base surface includes a first opening through which the lower base portion of the first panel extends and a second opening through which the lower base portion of the second panel extends.

In another implementation of the foregoing aspect, the first and second panels of each bracket diverge from a joint region where the corrugation receiving spaces are located. Each base pad member includes a first portion to a first side of the joint region and a second portion to a second side of the joint region. As to the bracket seated on each base pad member, the first panel and the second panel are located on the first portion of the base pad member, and the second portion of the base pad member is connected to a cable member that extends to another base pad member located on an opposite side of the containment boundary.

In another implementation of the foregoing aspect, each bracket includes first and second panels that diverge from a joint region where the corrugation receiving spaces are located. A plurality of base pad members are provided, wherein a multiplicity of the brackets are each seated on a respective base pad member. Each base pad member includes a first portion to a first side of the joint region, a second portion to a second side of the joint region. As to the bracket seated on each base pad member, the first panel and the second panel are located on the first portion of the base pad member, and the second portion of the base pad member extends within an area bounded by the containment boundary and is connected to a cable member that extends to another base pad member located on an opposite side of the containment boundary.

In another implementation of the foregoing aspect, each bracket is a primary bracket and includes first and second panels that diverge from a joint region where the corrugation receiving spaces are located, wherein the corrugation-receiving spaces of each primary bracket are fully open across the joint region. A plurality of corner brackets are used to angularly join wall members at corners of the containment boundary. Each corner bracket includes a plurality of corrugation receiving spaces and first and second panels that diverge from a joint region where the corrugation receiving spaces are located. The corrugation receiving spaces of the corner brackets are formed by spaced apart slots configured to slidingly receive corrugations of the wall members.

Other aspects of the disclosed structure and method will become apparent from the following description, the accompanying drawings, and the appended claims.

DETAILED DESCRIPTION

Figure 1:
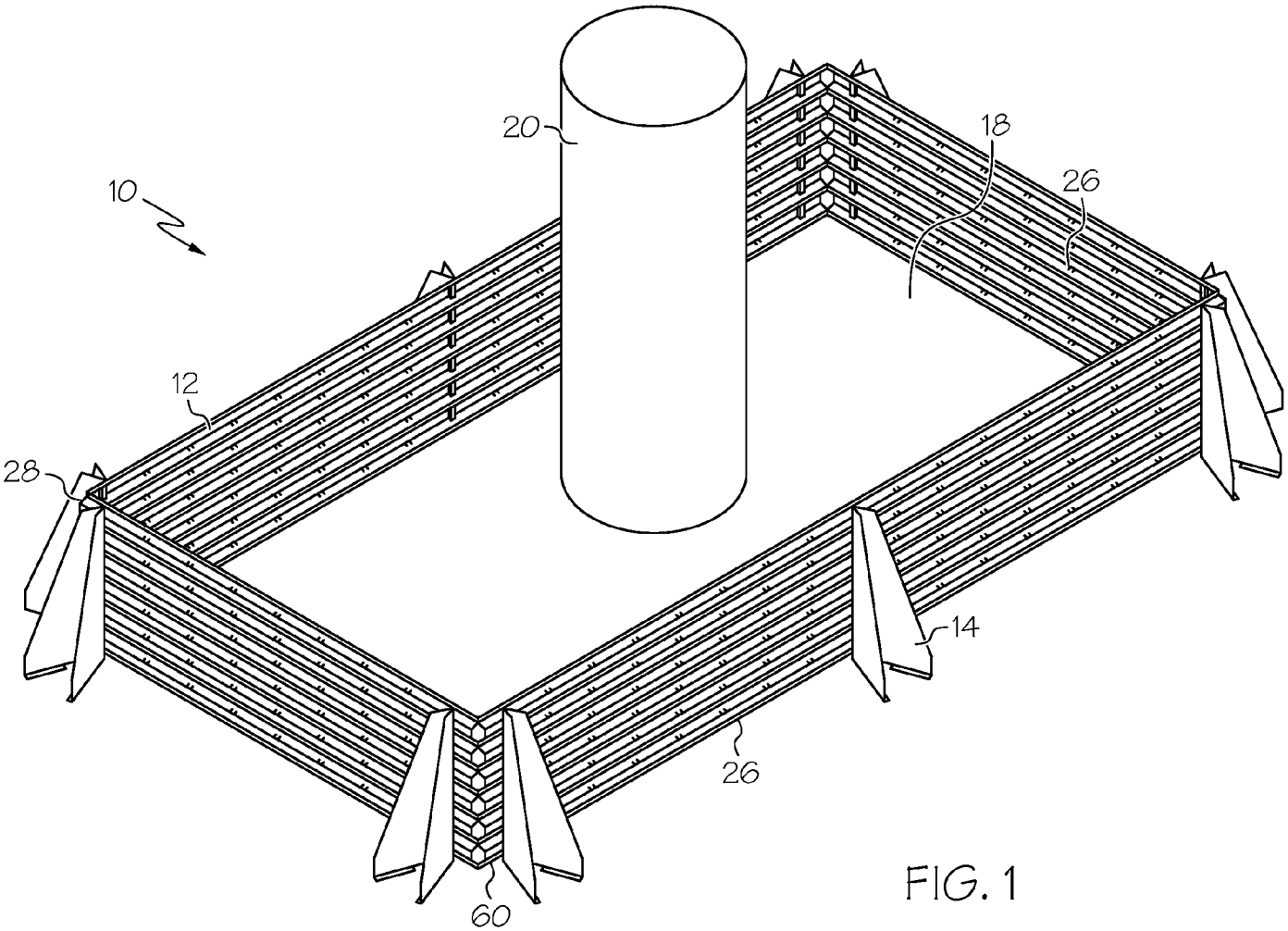
FIG. 1 is an isometric view of a containment system.

The following detailed description will illustrate the general principles of the invention, examples of which are additionally illustrated in the accompanying drawings. In the drawings, like reference numbers indicate identical or functionally similar elements.

Figure 2:
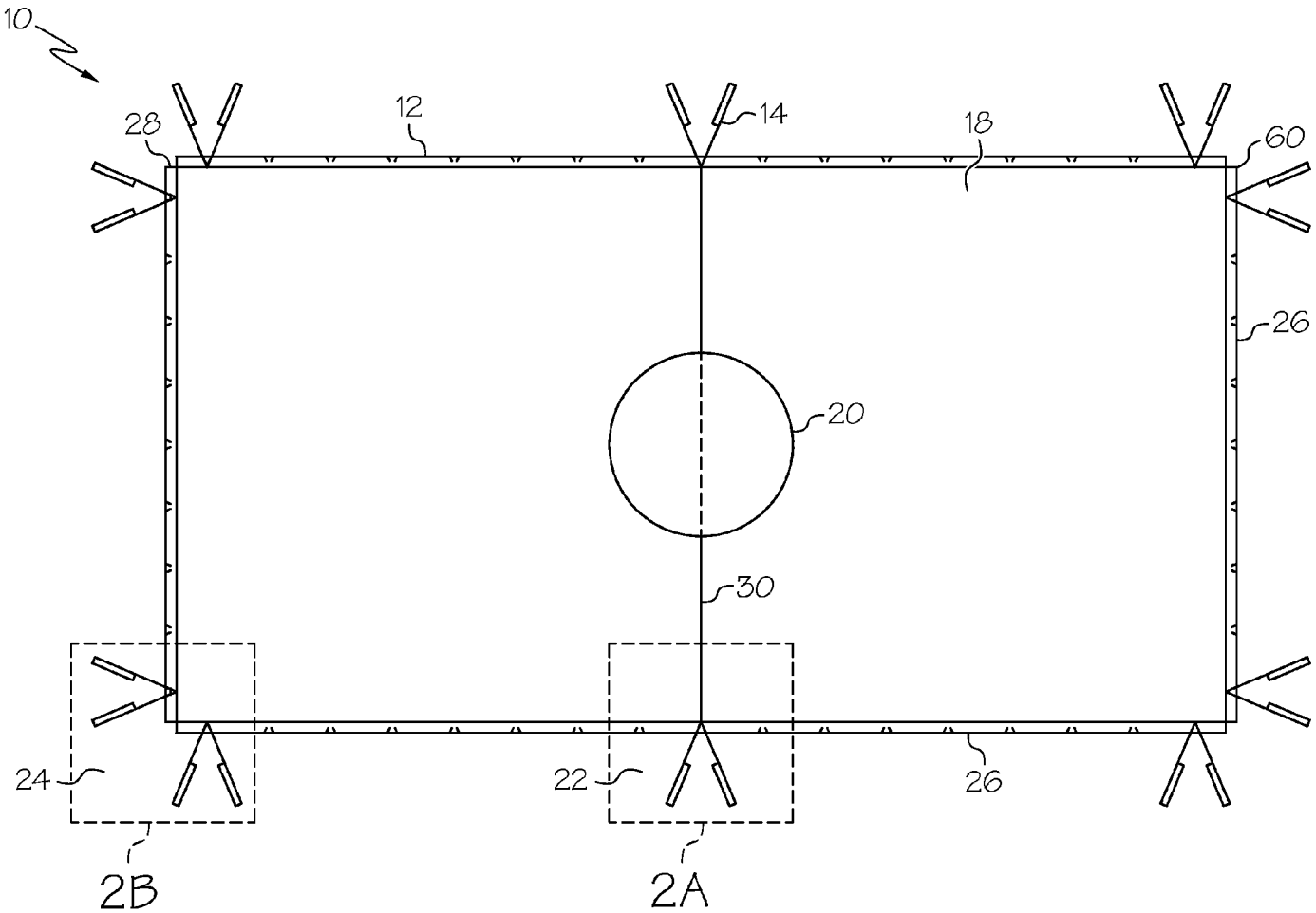
FIG. 2 is a top view of the containment system of FIG. 1.
Figure 2A:
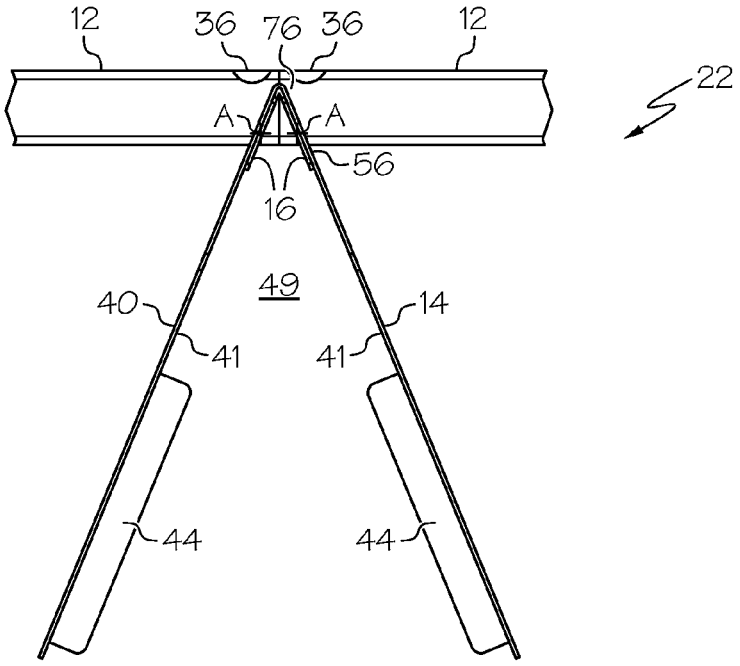
FIG. 2A is a detailed view of a wall joint of the containment system of FIG. 2.
Figure 2B:
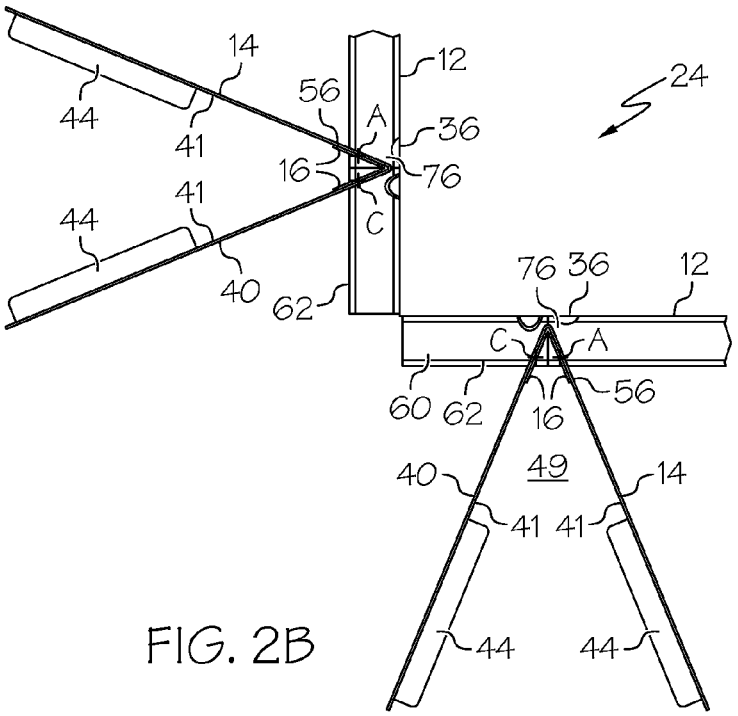
FIG. 2B is a detailed view of a corner joint of the containment system of FIG. 2.

Referring now to FIGS. 1 and 2, a containment system 10 is disclosed, the containment system 10 being formed from a series of interconnected wall members 12, primary brackets 14, and locking members 16 (seen from the top in FIGS. 2A, 2B). These structural components are assembled via a plurality of wall joints 22 and/or corner joints 24 to form the fully-assembled containment system 10. The fully-assembled containment system 10 may define the perimeter of an internal containment area 18, which may in turn contain one or more storage tanks 20. The total volume of the containment area 18, may meet or exceed the total volume of the contained storage tank(s) 20, such that the containment system 10 is capable of containing the outflow of any potential spill from the storage tanks 20, including a catastrophic spill where the entire contents of the storage tank(s) 20 spills into the containment area 18. A tarp or other liner (not shown) that is impermeable to the contents of the storage tank(s) 20, for example a geotextile fabric, may be attached to the wall members 12 or otherwise incorporated into the containment system 10 to line the internal containment area 18 to ensure that any spilled material from the storage tank(s) 20 remains safely within the internal containment area 18 and cannot escape to potentially contaminate the environment outside the containment system 10. Because the tarp/line is liquid impermeable and fully overlays the structural components of the containment system 10, the structural components themselves do not need to be assembled with liquid impermeable connections.

In the depicted embodiment, the containment system 10 has four sides 26 and is rectangular in shape, but the containment system 10 may alternately have any number of sides 26 of the same or varying lengths, and the system 10 may take any shape, regular or irregular, to form a closed loop that may define the containment area 18. In embodiments where the containment system 10 is polygonal, and has, for example, three, four, five, six, or eight sides 26 with angled corners 28 therebetween, the containment system may incorporate a plurality of corner joints 24, the details of which will be described in detail below, to facilitate corner formation. Depending on the required total length of the sides 26 and the length of the individual wall members 12, the sides 26 of the containment system 10 may further incorporate one or more wall joints 22, the details of which will be described in detail below, to connect wall members 12 together until each side 26 reaches the required length. In one embodiment, the sides 26 of the system may be about three feet high, and the brackets 14 may be situated at intervals of about six to about ten feet about the perimeter of the system 10, but the spacing may vary (e.g., 4 or 8 foot intervals).

The containment system 10 may alternately include one or more curved sides (not shown), and in one embodiment, may be generally circular or elliptical in shape. To facilitate such a system 10, some or all of the wall members 12 may be curved along their lengths, and wall joints 22 may be employed to connect the curved wall members 12 together until the desired size and shape of the system 10 is established. If the containment system 10 is circular, elliptical, or otherwise includes no corners 28, then the containment system 10 may be constructed without any corner joints 24 at all, instead incorporating only wall joints 22 until a closed loop is formed.

Further alternately, the wall members 12, brackets members 14, and locking members 16 of the containment system 10 may be used to construct a structure that does not form a complete closed loop. For example, a plurality of wall members 12 may be connected via wall joints 22 to form a curved or straight wall, fence, or other barrier structure. Any number of corner joints 24 may also be included to further customize the shape of the structure. Such a structure may be attached to an external support such as a building, or it may be free-standing. For the purposes of this disclosure and the appended claims, the term "containment system" includes such structures.

Figure 5:
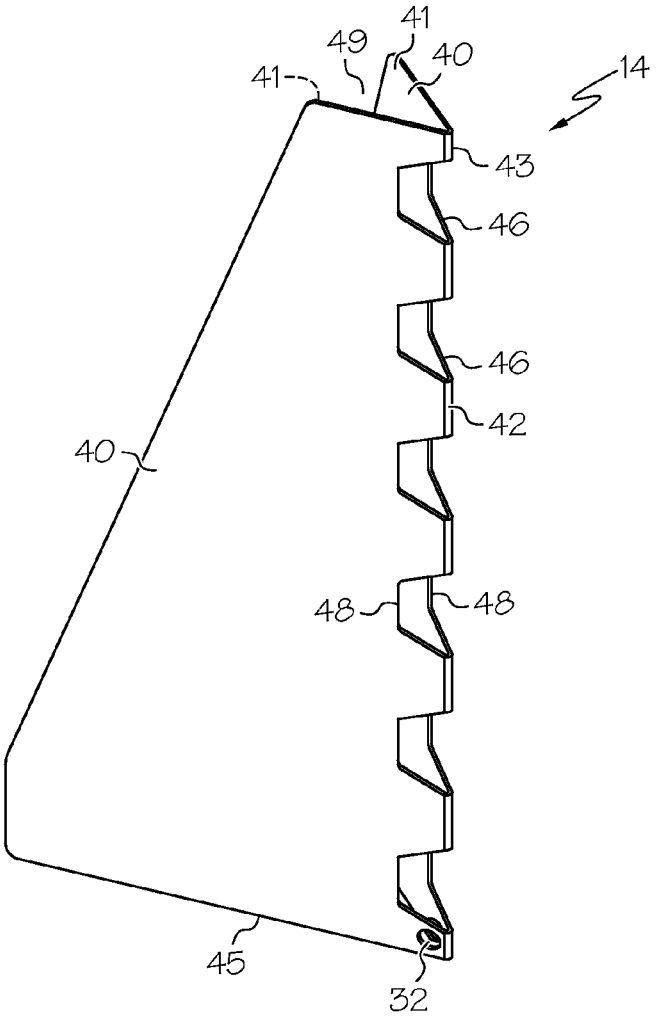
FIG. 5 is an isometric view of a bracket of the containment system of FIG. 1.

In one embodiment, the containment system 10 may be self-supporting, in that it requires no excavated foundation, support posts, stakes, anchors, or other support mechanism that deeply penetrates and/or materially disrupts the underlying ground on which the system 10 is situated. By eliminating the need to drive supports into the underlying support surface, the containment system 10 is suitable for use on rocky terrain or in other locations where ground disruption is difficult where the environmental impact of, for example, pouring concrete supports, is undesirable. The containment system 10 can be relocated from a use location with minimal or no environmental impact. To improve stability, the containment system 10 may include a plurality of cables 30 that extend across the bottom of the containment area 18 between various sides 26, for example between brackets members 14 that are situated across from and opposite to each other (see FIG. 2). The wall members 12 (FIG. 3) and bracket members 14 (FIG. 5) may include holes 32 therein to facilitate attachment of the cables 30 to the sides 26/brackets members 14. (With respect to the depicted wall member 12 in FIG. 3, holes 32 are shown on both the top and bottom edges of the wall member 12, but this is a function of the reversible nature of the wall member 12; when incorporated into a containment system 10, only the holes 32 actually located on the bottom of the wall member 12, when positioned, are used to attach the cables 30). It is not necessary that each hole 32 receive a cable 30. In other embodiments, or in conjunction with the described support cable embodiment, other support systems (ground-disrupting or otherwise) may be used to provide or further enhance the stability of the containment system 10.

The basic structure and functionality of the fully assembled containment system 10 having been described, the details of the components thereof will now be discussed.

Figure 3:
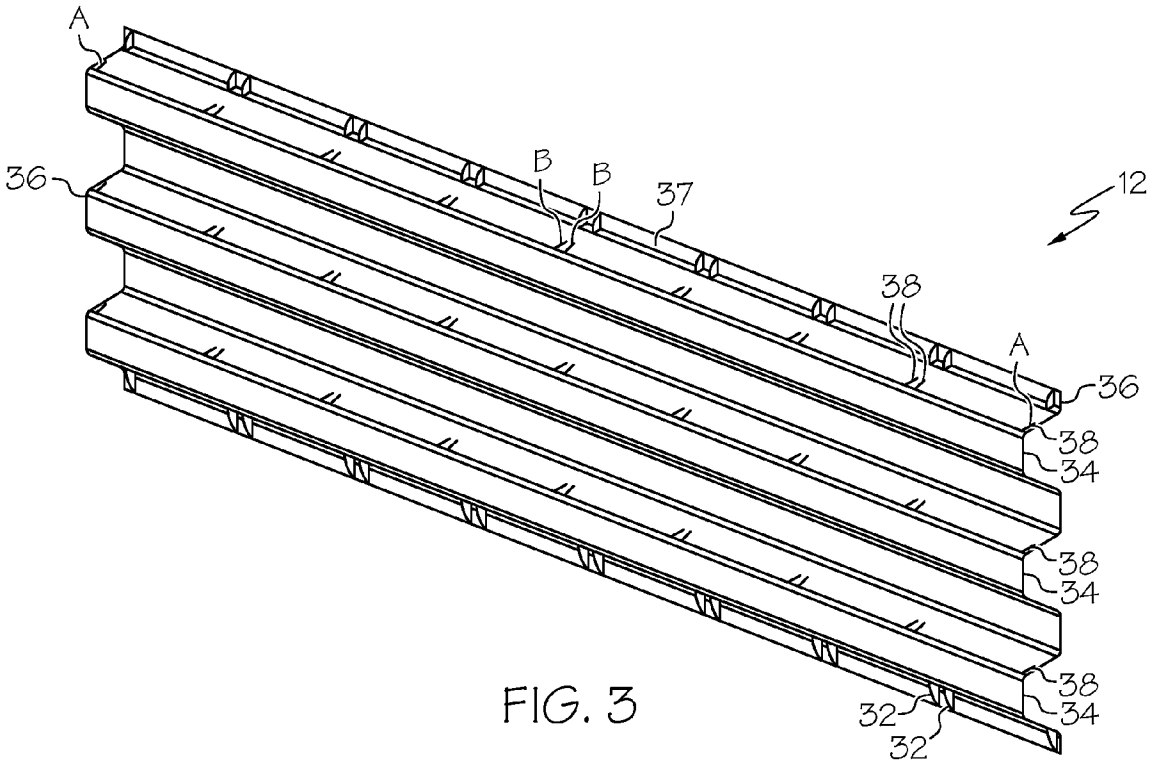
FIG. 3 is an isometric view of a wall member of the containment system of FIG. 1.
Figure 4:
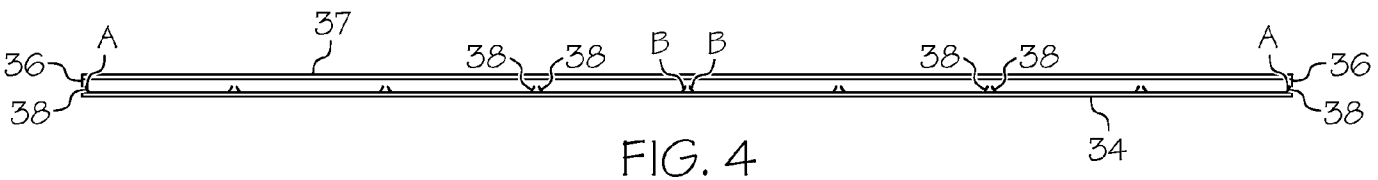
FIG. 4 is a top view of the wall member of FIG. 3.

Referring now to FIGS. 3 and 4, an embodiment of the wall member 12 is shown. The wall member 12 has a plurality of corrugations 34, where each corrugation 34 extends horizontally along the length of the wall member 12 between the lateral ends 36 thereof. In the depicted embodiment, three corrugations 34 are shown with trapezoidal corrugation profiles, but the wall member 12 may have any number of corrugations 34, and the corrugations 34 may alternately be round, square, or any other shape. A multiplicity of the corrugations 34 have openings 38 therein (note that each corrugation 34 with openings 38 has both a top and a bottom opening 38; the perspective of the figures tends to obscure the bottom openings 38). Each of the lateral ends 36 of the wall member 12 has openings 38 proximate thereto, and additional openings 38 may be positioned at regular or variable intervals along the lengths of the corrugations 34. As earlier described, the wall member 12 may have holes 32 therein for attachment to the cables 30.

Each opening 38 of the corrugations 34 is in vertical alignment with the openings 38 of other parallel corrugations 34 at the corresponding lateral position along the length of the wall member 12, such that the aligned openings 38 define a plurality of upright keyways A, B, where keyways A are the keyways located most proximate to the lateral ends 36 of the wall member 12 and keyways B are the keyways located along the intermediate length of the wall members 12 (in pairs). Alternately, instead of defining strictly vertical keyways A, B, the openings 38 may be positioned along the corrugations 34 to define upright, but angled, keyways A, B. In the depicted embodiment, the openings 38 and the resultant keyways A, B each have a cross-sectional shape, as viewed from the top, of a narrow slit (FIG. 4). However, the cross-sectional shape of the openings 38 and the keyways A, B may take any shape, including round, L/T/V/X-shaped, or any other shape. The cross-sectional shape of the openings 38 and keyways A, B may vary within a single wall member 12 and/or containment system 10.

Figure 6:
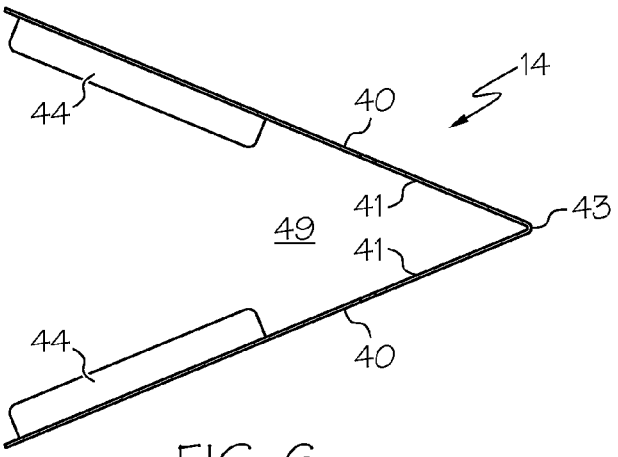
FIG. 6 is a top view of the bracket of FIG. 5.

Referring now to FIGS. 5-8, two embodiments of the bracket 14, 14' are shown. Turning first to the embodiment of FIGS. 5 and 6, the bracket 14 has two upright support panels 40 that are angularly connected to each other along a common vertical side 42 to form a V-shaped joint 43 (as viewed from the top; FIG. 6). In one embodiment, the support panels 40 are set at approximately a forty-five degree angle relative to each other. The support panels 40 may be generally triangular in shape, and they may include base portions 44 at the bottom edges 45 thereof to enhance stability of the bracket 14 and prevent the bottom edges 45 from digging into the underlying ground/support surface. The base portions 44 may take any of a variety of sizes and shapes, and they may be located wholly between the support panels 40 as shown in FIG. 6, wholly outside the support panels 40 as shown in the alternate embodiment of FIG. 8, or partially inside and partially outside the support panels 40. The base portions 44 and the support panels 40 may be monolithic, where the base portions 40 are formed by bending the bottom edge 45 of the support panels 40. Further alternately, both of the upright support panels 40 may share a common base portion 44, such as a platform that underlies the entire bracket 14. As earlier described, the bracket 14 may also have holes 32 therein for attachment to the cables 30.

The bracket 14 has a plurality of corrugation-receiving spaces 46 therein. The corrugation-receiving spaces 46 result from stepped notches 48 formed along sides 42 of the support panels 40, sized to generally conform with the corrugation profile of the wall members 12, such that the wall members 12 can be positioned proximate to the bracket 14 with a portion of at least some of the corrugations 34 inside the bracket 14. The "inside" 49 of the bracket 14 is the space between the planes defined by the inside surfaces 41 of the support panels 40. The corrugations 34 of the wall members 12 may be positionable in the corrugation-receiving spaces 46 of the bracket 14 such that the keyways A, B of the wall members 12 are inside the bracket 14, but other portions of the corrugations 34 of the wall members 12 are outside the bracket.

Figure 7:
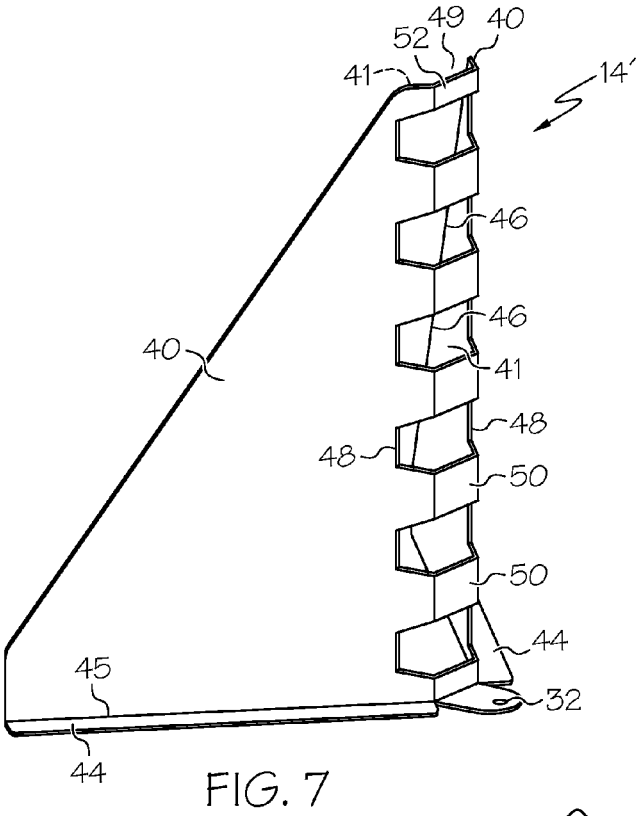
FIG. 7 is an isometric view of an alternate embodiment of a bracket for a containment system.
Figure 8:
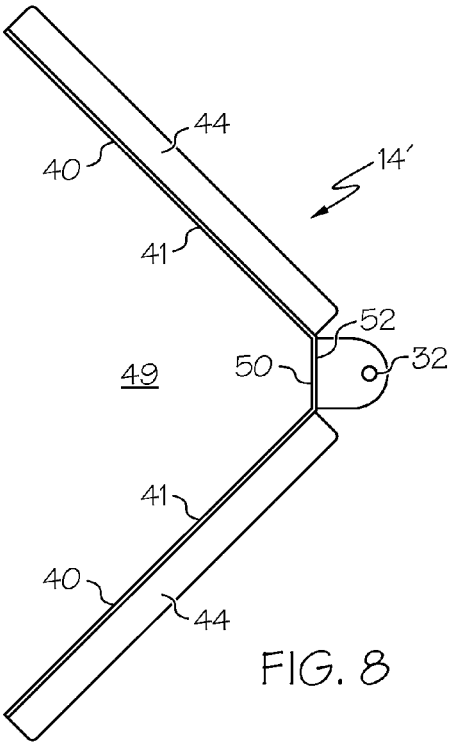
FIG. 8 is a top view of the bracket of FIG. 7.

Referring now to FIGS. 7 and 8, an alternate embodiment of the bracket 14' is shown. This embodiment includes essentially the same features as the previously-described bracket 14, such as the support panels 40, the base portions 44, the corrugation-receiving spaces 46, and the stepped notches 48. However, the support panels 40 of the bracket 14' lack a common vertical side 42, and are instead joined along a plurality of connecting segments 50 which space the support panels 40 away from each other. Thus, instead of forming a V-shaped joint, the support panels 40 of the bracket 14' are connected along a generally U-shaped joint 52 (as viewed from the top; FIG. 8) with the connecting segments 50 therebetween. The inclusion of the connecting segment 50 increases the size of the inside 49 of the bracket 14', as compared to the bracket 14, and allows the bracket 14' to potentially receive longer segments of the wall members 12 therein than the bracket 14 of FIGS. 5 and 6. This, in turn, increases the options with respect to the size and shape of the openings 38 of the wall members 12 because larger keyways A, B may fit inside the bracket 14'.

The bracket 14 may take any of a variety of alternate forms other than the depicted embodiments. For example, the bracket 14 may include upright support panels 40 that are set at an angle relative to each other, as opposed to the depicted vertical orientation, such that the top forms a V-shaped joint similar to that shown in FIG. 5, but the bottom forms a U-shaped joint similar to that shown in FIG. 7. Such an embodiment may be used in conjunction with an embodiment of the wall member 12 where the keyways A, B are angled. Many other variations of the bracket 14 are possible without departing from the present disclosure.

Figure 10:
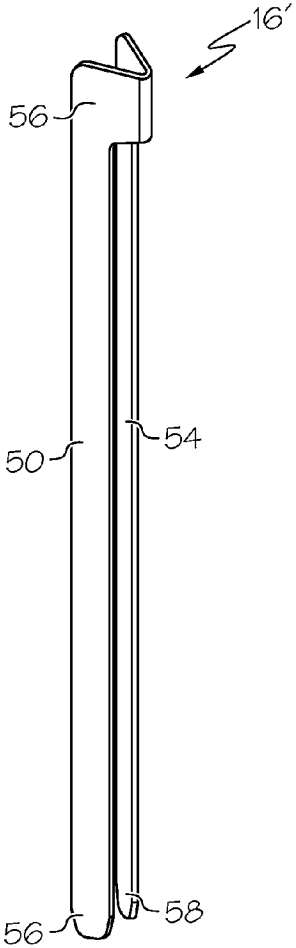
FIG. 10 is an isometric view of an alternate embodiment of a locking member for a containment system.
Figure 9:
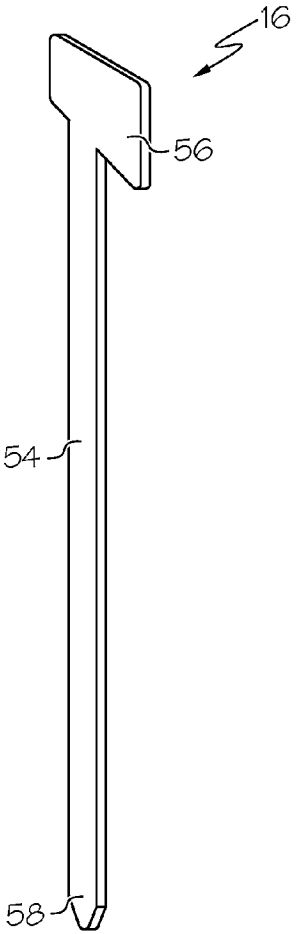
FIG. 9 is an isometric view of a locking member of the containment system of FIG. 1.

Referring now to FIGS. 9 and 10, two embodiments of the locking member 16, 16' are shown. Turning first to the embodiment of FIG. 9, the locking member 16 has an insertion portion 54 and a lock portion 56. The insertion portion 54 is shaped and sized to be slidingly received in the keyways A, B of the wall member 12. Thus, in the depicted embodiment, the insertion portion 54 is shaped as a narrow bar to correspond with the narrow slit shape of the openings 38 that define the keyways A, B. The insertion portion 54 may have a tapered or rounded end 58 to facilitate easy insertion into the keyways A, B. The insertion portion 54 may be long enough to simultaneously pass through all of the openings 38 that define the keyway A, B in which it is inserted, or it may alternately pass through only a portion of the openings 38. The locking member 16 may have a loose-fit tolerance to ensure that the locking member 16 is sufficiently maneuverable to slide it into position within the keyway A, B.

The lock portion 56 is shaped and sized to be larger than the openings 38 of the keyways A, B. Therefore, when a locking member 16 is inserted into a keyway A, B, the lock portion 56 prevents the locking member 16 from passing entirely through the keyways A, B, thereby securing the locking member 16 in a relatively fixed position within the keyway A, B.

Turning now to the embodiment of locking member 16' shown in FIG. 10, a single lock portion 56 may be associated with more than one insertion portion 54 to facilitate entry of the locking member 16' into two keyways simultaneously, where the two keyways are set at a known orientation at a known distance from each other that corresponds with the positioning of the insertion portions 54. For example, with reference to both FIGS. 3 and 10, the insertion portions 54 of locking member 16' could be inserted into both labeled keyways B of FIG. 3 because the shape, separation distance, and relative orientation of the insertion portions 54 are compatible with the shape, separation distance, and relative orientation of the keyways B.

Figure 11:
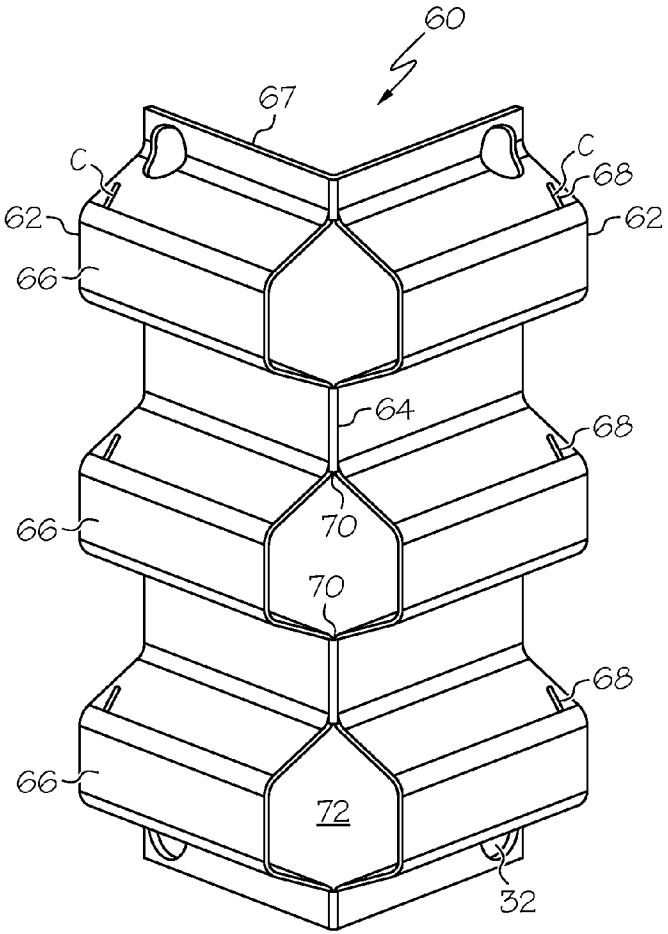
FIG. 11 is an isometric view of a corner member of the containment system of FIG. 1.

Referring now to FIG. 11, an embodiment of a corner member 60 is shown. The corner member 60 is essentially a specialized version of the wall member 12, and many of the basic attributes of the wall member 12 (corrugation shape, etc.) apply equally to the corner member 60. The corner member 60 has two portions 62 that are set at angle relative to each other about a vertical corner seam 64 that defines the boundary between the two portions 62. The angle is variable depending upon the desired shape of the containment system 10. For example, for a rectangular containment system 10, the angle may be 90 degrees, but for a regular hexagonal containment system 10, the angle may be 120 degrees. The corner member portions 62 each having a plurality of corrugations 66 ("corner corrugations"), where each corrugation 66 extends horizontally along a length of the respective portion 62 of the corner member 60. A multiplicity of the corrugations 66 having openings 68 therein (note that each corrugation 66 with openings 68 has both a top and a bottom opening 68; the perspective of the figures tends to obscure the bottom openings 68). Each opening 68 of the corrugations 66 is in vertical alignment with the openings 68 of other parallel corrugations 66 at the corresponding lateral position along the length of the portion 62 of the corner member 60, such that the aligned openings 68 define keyways C that are analogous to keyways A, B of the wall member 12. Each portion 62 of the corner member 60 includes at least one keyway C. The corner members 60 may have holes 32 therein for attachment to the cables 30.

In one embodiment, the vertical corner seam 64 is a partially severed corrugation 70, where a piece of corrugated material has been cut almost entirely through, but leaving the corrugated material intact along a single discontinuous plane. Thus, the corner member 60 may be bent to the requisite angle by bending along the partially severed corrugation 70. This facilitates formation of the vertical corner seam 64 more easily than, for example, bending an intact section of corrugated material, which would require stretching and deforming intact corrugations. Utilizing this type of vertical seam 64 also results in gaps 72 between the corrugations 66 of the two portions 62 of the corner member 60.

In the depicted embodiment, the portions 62 of the corner member 60 are relatively short in length, where each portion 62 contains only one keyway C. However, the corner member 60 may alternately include longer portions 62, equal to or longer in length than the wall members 12. In such embodiments, the portions 62 of the corner member 60 may include additional openings 68 to facilitate the formation of additional keyways analogous to keyways B of the wall member 12. Also, the portions 62 may have different lengths.

The bracket 14 and the locking member 16 interact with the corner member 60 in the same way that they interact with the wall member 12. For example, the corrugations 66 of the corner member 60 are positionable within the corrugation-receiving spaces 46 of the bracket 14 such that the keyway C of the corner member 60 is positioned inside the bracket 14. Similarly the insertion portion 54 of the locking member 16 is positionable within the keyway C of the corner member 60.

The components of the containment system 10 having been described, the manner and method by which they are assembled to form the containment system 10 will now be explained. Essentially, the containment system 10 is assembled through the variable combination of three basic constructs: wall joints 22, corner joints 24, and brace points.

Figure 12:
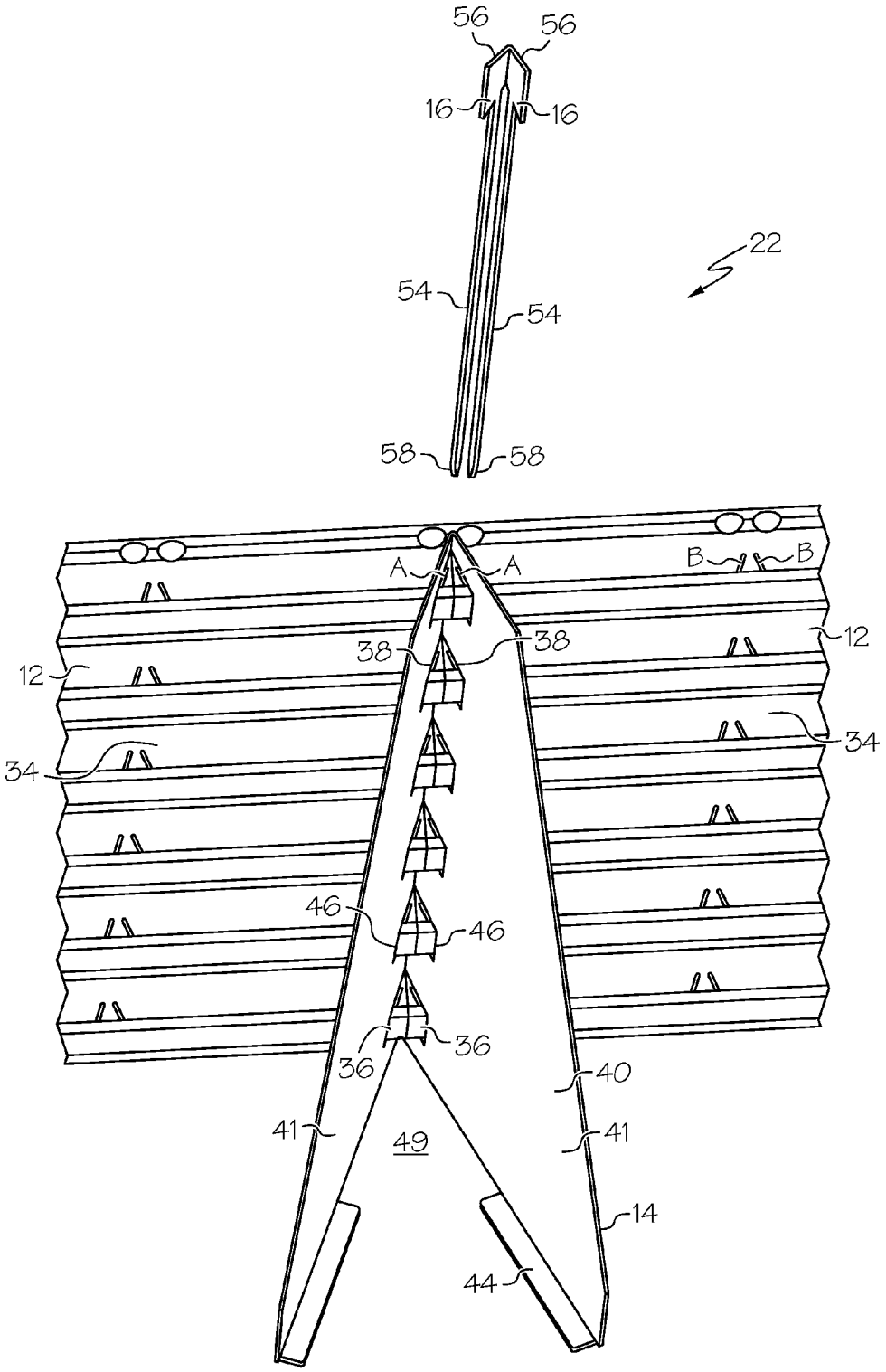
FIG. 12 is partially disassembled view of a wall joint of the containment system of FIG. 1.

FIGS. 2A and 12 depict wall joints 22. FIG. 2A shows the fully assembled wall joint 22 from the top, and FIG. 12 shows the wall joint just prior to the insertion of the locking members 16. The wall joint 22 is formed by inserting two wall members 12 into a bracket 14, and securing the wall members 12 and the bracket 14 together with locking members 16. The lateral ends 36 of the two wall members 12 are positioned end-to-end proximate to each other, and in one embodiment abutting each other, within the bracket 14 such that the corrugations 34 of both of the wall members 12 are in the corrugation-receiving spaces 46 of the bracket 14 and the keyways A of both of the wall members 12 are inside the bracket 14. The insertion portion 54 of the locking member 16 is inserted into the keyway A of each wall member 12, and the locking members 16 are slid through the keyways A until the lock portion 56 is engaged against the top surface of the corrugation 34 at the entrance of the keyway A. The locking members 16 in each keyway A are therefore also inside the bracket 14. Thus, the wall joint 22 is stably formed, because the locking members 16 are secured to the wall members 12 by virtue of their insertion into the keyways A, and the interaction between the locking members 16 and the inside surfaces 41 of the support panels 40 of the bracket 14 prevent the wall members 12 from being pulled away from the bracket 14, or each other.

Figure 13:
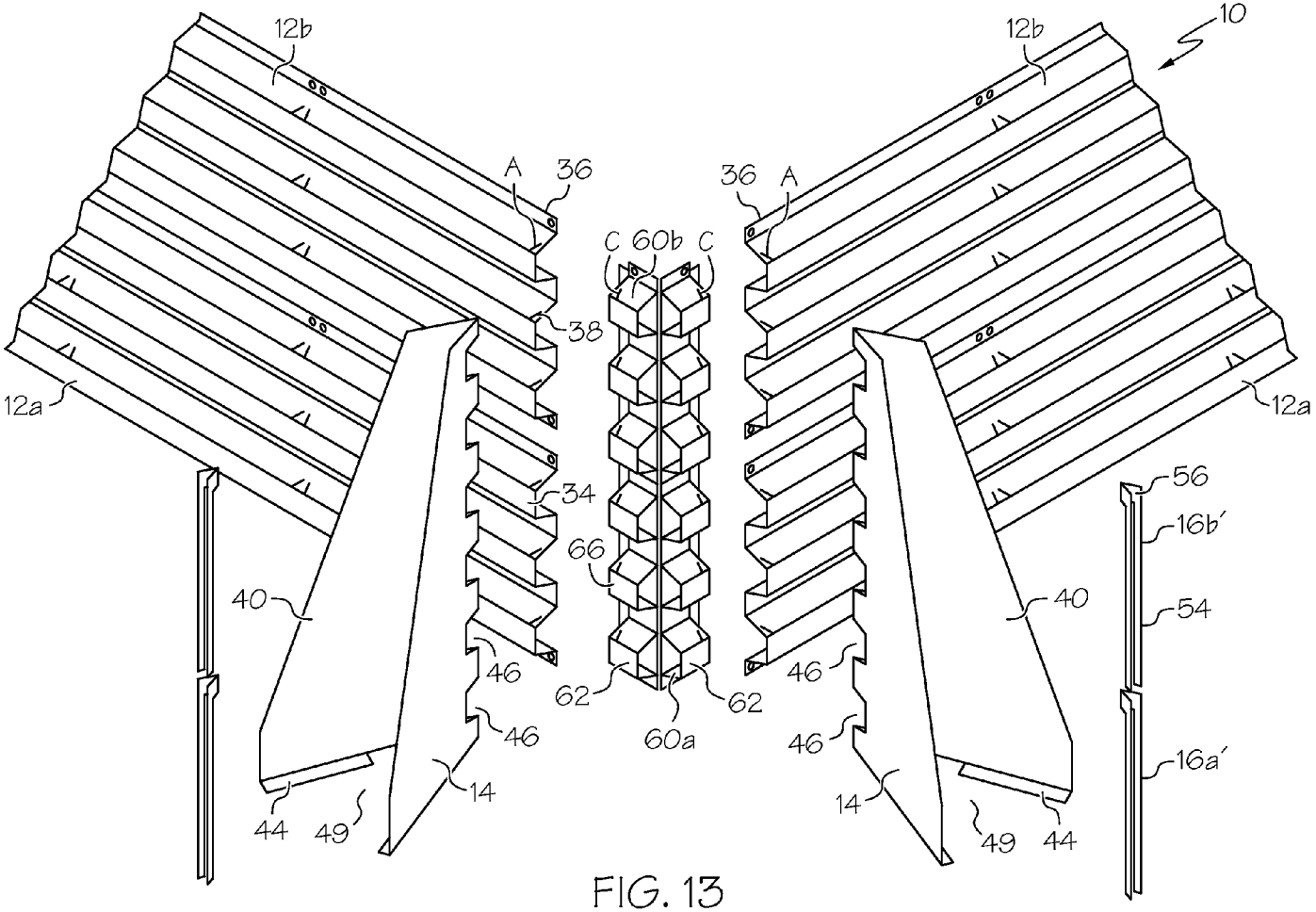
FIG. 13 is a disassembled view of an embodiment of a corner joint of a containment system.

FIGS. 2B and 13 depict one embodiment of a corner joints 24. The corner joint 24 is formed using the same basic principles as a wall joint 22, but instead of attaching two wall members 12 together with a single bracket 14, two brackets 14 are used to attach two wall members 12 to the corner member 60, one to each portion 62 thereof. The lateral end 36 of the first wall member 12 is positioned end-to-end proximate to the end of one portion 62 of the corner member 60 within the bracket 14 such that the corrugations 34 the wall members 12 and the corrugations 66 of the portion 62 of the corner member 60 are in the corrugation-receiving spaces 46 of the bracket 14. Both the keyway A of the wall members 12 and the keyway C of the portion 62 of the corner member 60 are thus inside the bracket 14. The insertion portion 54 of a locking member 16 is inserted into the keyway A of the wall member, and the insertion portion 54 of another locking member 16 (or, in the case of locking member 16', a second insertion portion 54 of the same locking member 16') is inserted into the keyway C of the portion 62 of the corner member 60. The locking members 16 are slidingly guided through the respective keyways A, C until each lock portion 56 is engaged against the top surface of the corrugation 34, 66 at the entrance of the respective keyway A, C. The locking members 16 in each keyway A, C are therefore also inside the bracket 14. Thus, the first half of the corner joint 22 is stably formed, because the locking members 16 are secured to the wall member 12 and corner member 60 by virtue of their insertion into the keyways A, C, and the interaction between the locking members 16 and the inside surfaces 41 of the support panels 40 of the bracket 14 prevent the wall member 12 and corner member 60 from being pulled away from the bracket 14, or each other. The second half of the corner joint 22 is formed by repeating this process to connect the second wall member 12 to the other portion 62 of the corner member.

Referring now to FIGS. 15-19, as an alternative to the use of two brackets 14 in conjunction with a corner member 60 to facilitate the formation of the corner joint 24, a specialized corner bracket 78 may be used to directly connect two wall members 12 to form a corner joint 24', thus eliminating the need for corner members 60. A single containment system 10 may incorporate both forms of the corner joints 24, 24'. The corner bracket 78 includes essentially the same features as the bracket 14, including two upright support panels 80, base portions 82, a plurality of corrugation-receiving spaces 84, and any other features earlier described with respect to the bracket 14 that are not incompatible with the functionality of the corner bracket 78 described herein, even if not expressly discussed and described with respect to the corner bracket 78. The support panels 80 may be generally triangular in shape. The upright support panels 80 may be angularly connected to each other along a common vertical side 86 to form a V-shaped joint 88 (as seen from the top, FIG. 16). In one embodiment, the support panels 80 are set at approximately a 135° angle relative to each other, but variations are possible. In an alternate embodiment (not shown, except as a dashed line in FIG. 18 as described in more detail below), the support panels 80 may lack a common vertical side 86, and instead join together along a plurality of connecting segments 96 which space the support panels 80 away from each other in a manner analogous to the embodiment of the bracket 14' as discussed above and as shown in FIGS. 7 and 8. Thus, instead of forming a V-shaped joint, the support panels 80 of the corner bracket 78 would connect along a generally U-shaped joint (as viewed from the top, see FIG. 18, dashed line) with the connecting segments 96 therebetween.

Figure 17:
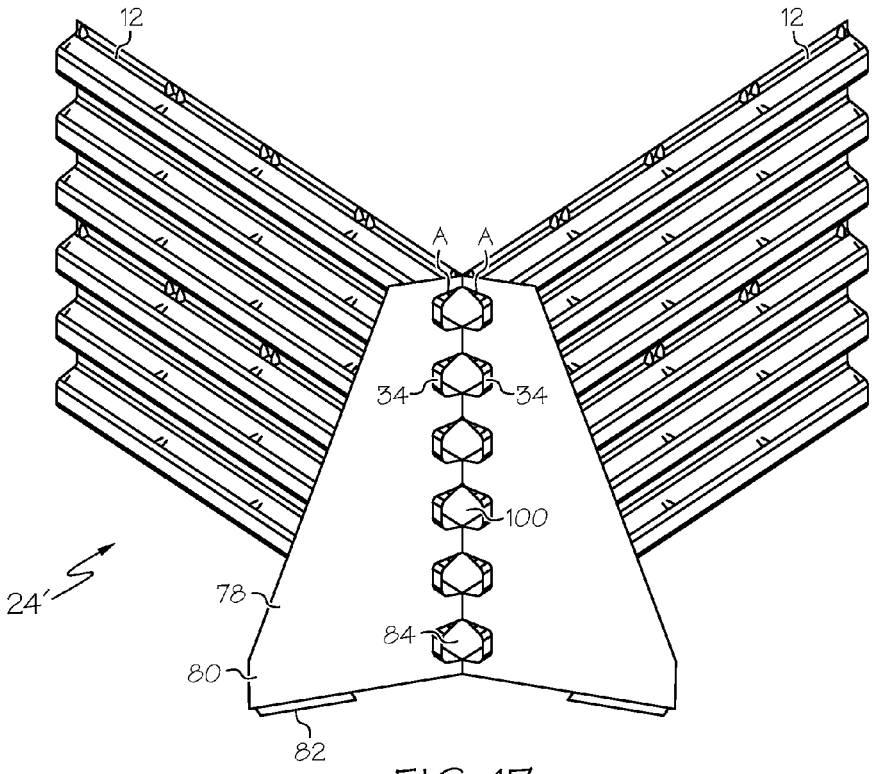
FIG. 17 is an isometric view of a corner joint of a containment system incorporating the corner bracket of FIG. 15.
Figure 18:
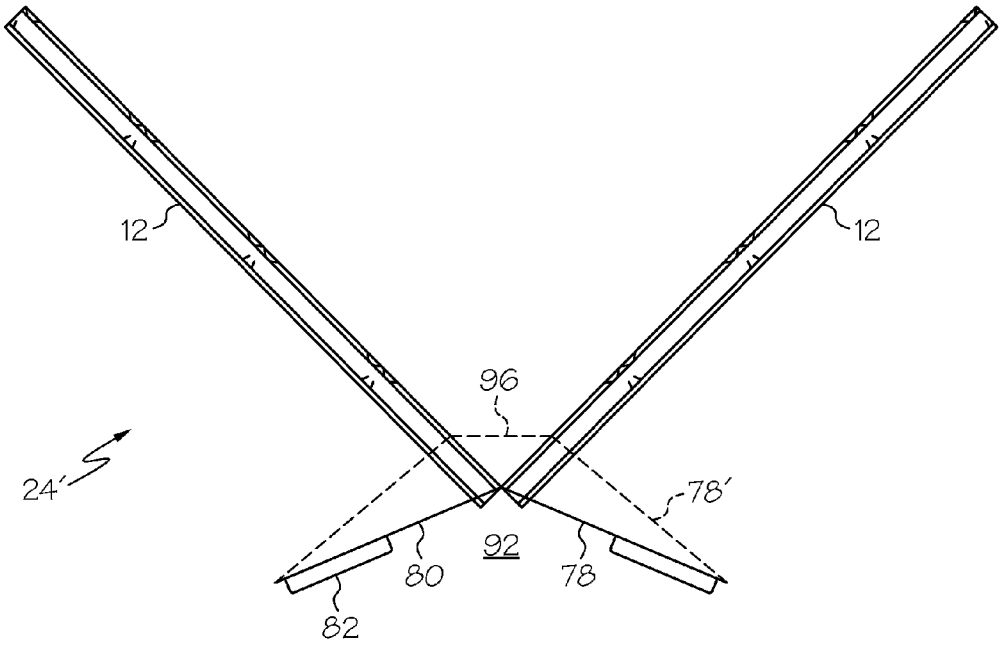
FIG. 18 is a top view of the corner joint of FIG. 17.

The plurality of corrugation-receiving spaces 84 of the corner member 60, in one embodiment, are defined by stepped notches 90 formed along the vertical side 86 of the support panels 80 that are sized to generally conform with the corrugation profile of the wall members 12, such that the wall members 12 can be positioned proximate to the corner bracket 78 with a portion of at least some of the corrugations 34 inside the corner bracket 78. The "inside" 92 of the corner bracket 78 is the space between the planes defined by the inside surfaces 94 of the support panels 80. As seen in FIGS. 17 and 18, the corner bracket 78 receives two wall members 12 to form the corner joint 24', where the corrugations 34 of the wall members 12 are positionable in the corrugation-receiving spaces 84 of the corner bracket 78 such that the keyways A of the wall members 12 are inside the corner bracket 78, but other portions of the corrugations 34 of the wall members 12 are outside the bracket. Locking members 16 may then be positioned through the keyways A of the wall members 12 to secure both of the wall members 12 of the corner joint 24' to the corner bracket 78. The keyways A, the locking members 16, and the other features of the corner joint 24' function in essentially the same way as earlier described with respect to the embodiment of the corner joint 24 depicted in FIGS. 2B and 13, except that instead of using two brackets 14 to attach a specialized corner member 60 to two wall members 12, the singular corner bracket 78 receives two wall members 12 directly to establish the corner joint 24' without the use of a corner member 60.

In an embodiment with a corner bracket 78' that includes a U-shaped joint instead of a V-shaped joint (shown as a dashed line in FIG. 18 to illustrate relative placement as compared to corner bracket 78; this should be understood to represent an alternative to the depicted corner bracket 78, not as an optional additional component to a given corner joint 24'), the corner bracket 78 may be adapted such that a connecting segment 96 of the U-Shape joint is positioned at least partially between the wall members 12. This arrangement may, amongst other benefits, increase the stability of the corner joint 24' and facilitate a wider variety of cross-sectional shapes for the keyways A.

Figure 20:
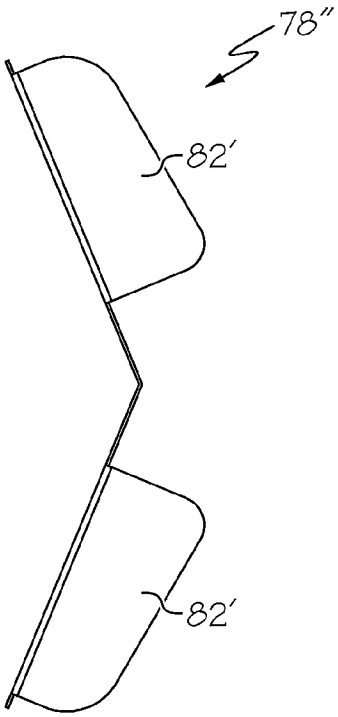
FIG. 20 is a top plan view of the corner bracket of FIG. 19.
Figure 19:
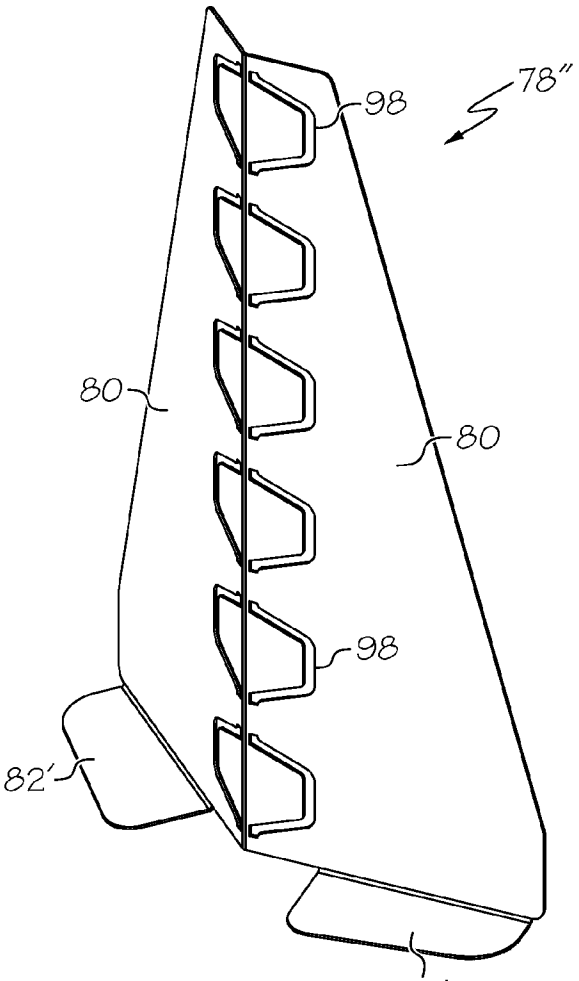
FIG. 19 is an isometric view of an alternate embodiment of a corner bracket.

Referring now to FIG. 19 and FIG. 20, an alternate embodiment of the corner bracket 78" is shown. In corner bracket 78", the corrugation-receiving spaces 84 take the form of slots 98 shaped and sized to receive the corrugations 34 of the wall members. The use of corner bracket 78" eliminates or minimizes the open holes 100 that would otherwise exist between the wall members 12 at the corner joint 24' (see FIG. 17) in embodiment of the corner bracket 78 that uses open corrugation-receiving spaces 84. The brackets 14 may similarly employ features analogous to the slots 98 of corner bracket 78" as corrugation-receiving spaces 46. Enlarged base portions or feet 82' are provided on the containment area facing side of the bracket in this embodiment.

The figures do not expressly depict the brace point, but its construction is easily understood with reference to FIG. 12, which shows the wall joint 22. While the wall joint 22 and corner joint 24 are each designed to connect various components of the containment system 10 together, the brace point does not join components, but rather provides added support along the length of a wall member 12 (and/or a corner member 60, if the portions 62 are long enough to warrant such treatment). To form the brace point, a bracket 14 is placed along the outside of the wall member 12 such that the corrugations 34 are positioned within the corrugation-receiving spaces 46, and such that the openings 38 corresponding with two of the keyways B are positioned inside the bracket 14. Then, in accordance with the principles earlier-described with respect to the wall joint 22 and the corner joint 24, locking members 16 are inserted into the keyways B, inside the bracket 14, to secure the bracket 14 to the wall member 12, thereby forming the brace point and providing extra structural support at that location along the containment system 10. With reference to FIG. 12, a brace point could thus be established to the right of the depicted wall joint by positioning an additional bracket 14 to contain the labeled keyways B therein in a manner analogous to the depicted positioning of the bracket 14 that contains the keyways A of two neighboring wall members 12, and then securing the additional bracket 14 into position with additional locking members 16.

Figure 14:
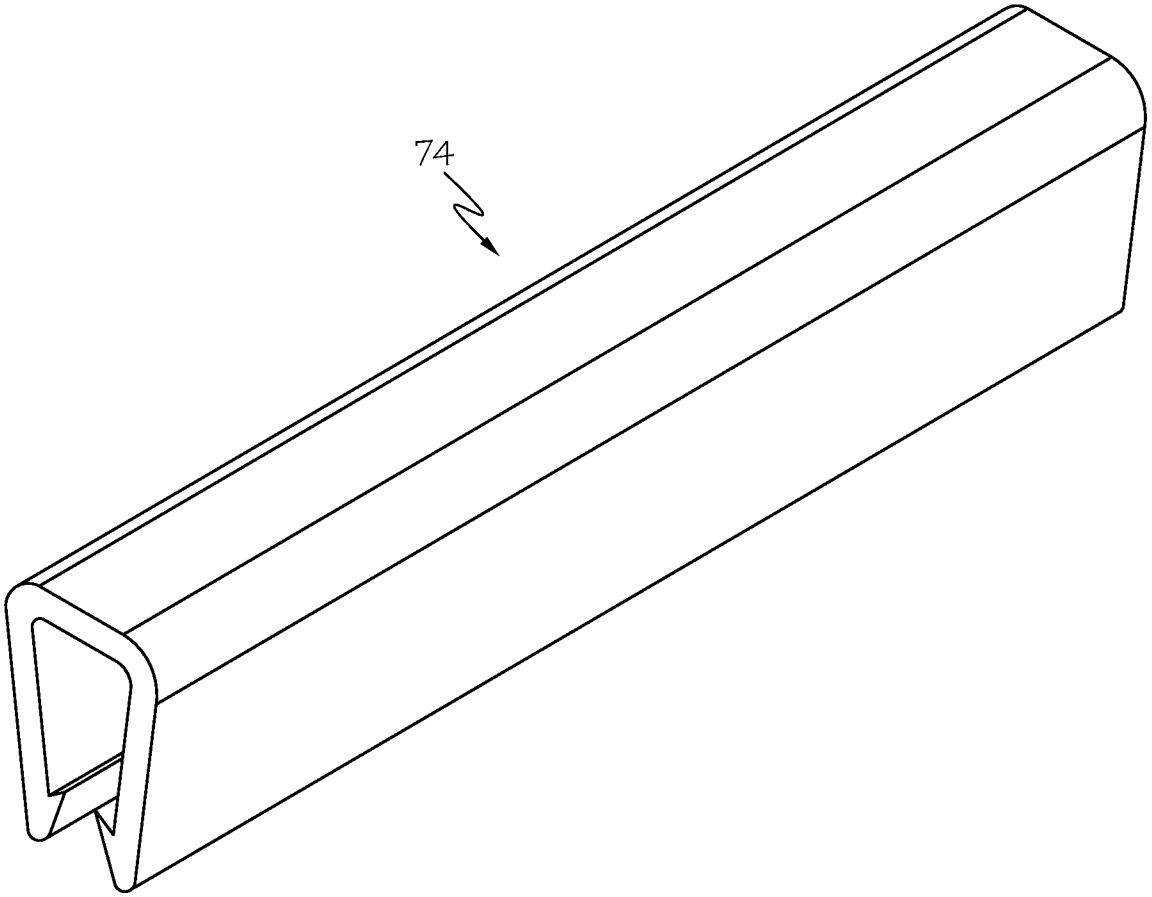
FIG. 14 is an isometric view of an edge cap for use with the containment system of FIG. 1.
Figure 15:
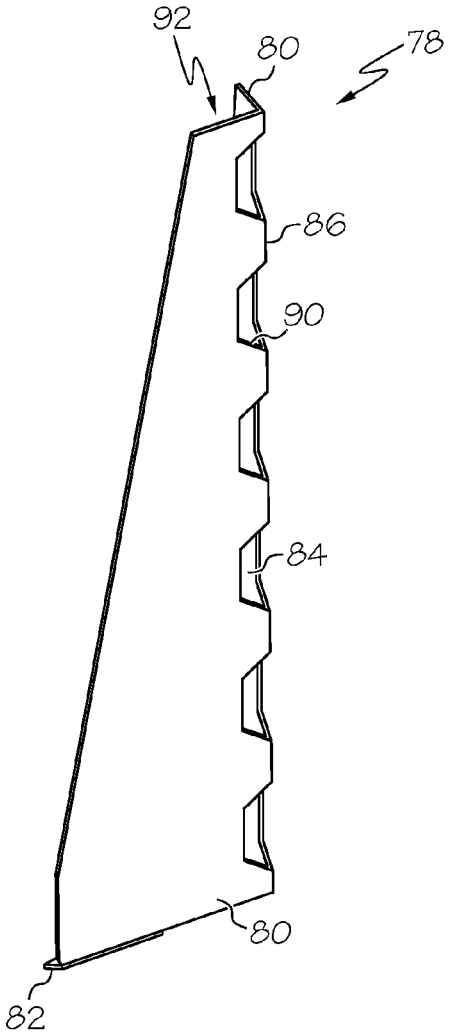
FIG. 15 is an isometric view of an embodiment of a corner bracket for a containment system.
Figure 16:
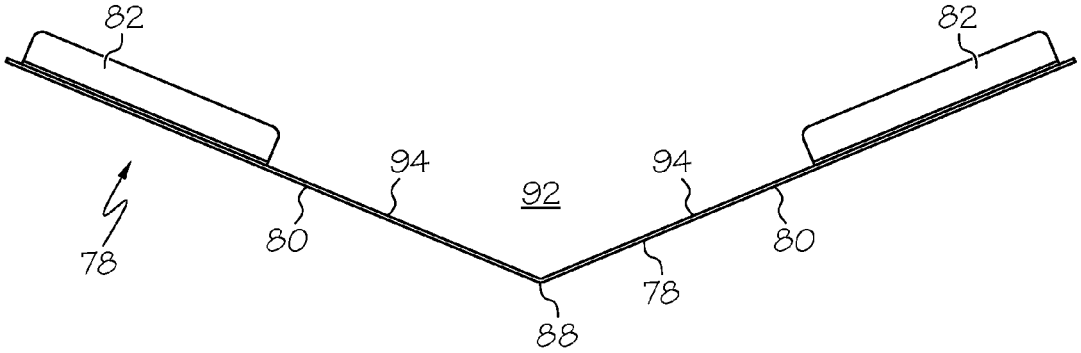
FIG. 16 is a top view of the corner bracket of FIG. 15.

Referring now to FIG. 14, an edge cap 74 may be incorporated into the containment system 10 that can be snap-fit/pounded/pressed into position over a top edge 37 of the wall member 12 (FIG. 3). The edge cap 74 provides a covering over what may otherwise have been a somewhat thin or sharp material edge. If the containment system 10 incorporates an impermeable tarp or other liner (not shown) as earlier described, the tarp or liner may be positioned over the top edge 37 of the wall member 12, and the edge cap 74 may be pressed over the top of the top edge 37 to secure the tarp or liner between the edge cap 74 and the wall member 12. As seen in FIGS. 2A and 2B, the wall members 12, corner members 60 (which may also have a top edge 67), and brackets 14 may be formed such that when assembled, the V-shaped joint 43 (or connecting segment 50, in the case of bracket 14'), does not extend to contact the vertical plane of the top edge 37, 67, thereby leaving a space 76 between the V-shaped joint 43 and the top edge 37, 67. Thus, in addition to placement across continuous top edges 37, 67, edge caps 74 may also be positioned across the abutting ends 36 of two wall members 12 or a wall member 12 and a corner member 69 in a wall joint 22 or a corner joint 24 without interfering with the placement of the bracket 14.

By variously assembling a plurality of wall members 12, corner members 60, brackets 14, corner brackets 78, and locking members 16 to form and interconnect wall joints 22, corner joints 24, 24' and brace points, a containment system 10 of any size and shape can be formed, with or without a tarp or liner and/or a plurality of edge caps 74. The containment system 10 may be provided in the form of a kit containing all or some of these components in a disassembled state, thus enabling an end user to design a containment system 10 suitable for that end user's specific needs. Such a kit could further include the cables 30 to establish a self-supporting structure. The kit and subsequent assembly of the system 10 requires no bolts or other fasteners (aside from locking members 16 and, if applicable, edge caps 74), but bolts or other fasteners could alternately be included to provide further support.

The components of the containment system 10 can be formed of any of a variety of materials. For example, some or all of the wall members 12, corner members 60, brackets 14, corner brackets 78, and locking members 16 may be formed of 12 to 16-gauge steel, which may be galvanized to increase corrosion resistance. In one embodiment, the wall members 12 and corner members 60 are formed of 16-gauge steel, but the brackets 14 and locking members 16 are formed of 12-gauge steel. Other materials capable of forming corrugations, such as plastics, polymers, and the like, may alternately be used for to form these components where such materials are appropriate given the use of the containment system 10. The edge cap 74 may be formed of vinyl, rubber, plastic, polymer, and the like.

The components of the containment system 10 may be of any size appropriate for a particular application, and/or the system may be modular in nature. FIG. 13 illustrates one embodiment of a containment system illustrating the use of modular components. As shown in the depicted (disassembled) corner joint 24, the brackets 14 each contain six corrugation-receiving spaces 46 therein. However, instead of using wall members 12/corner members 60 with six sets of parallel corrugations 34, 66, that extend the full heights of the brackets 14, two levels of wall members 12*a*, 12*b*/corner members 60*a*, 60*b*, each with three sets of parallel corrugations 34, 66 are positioned vertically atop each to collectively establish the requisite height. The bottom wall members 12*a*/corner members 60*a* are positioned for insertion into the bottom three corrugation-receiving spaces 46 of the brackets 14, and the top wall members 12*b*/corner members 60*b* are positioned for insertion into the top three corrugation-receiving spaces 46 of the brackets 14.

Similarly, FIG. 13 depicts the use of two vertically aligned locking members 16*a*', 16*b*', for insertion into the keyways A, C of the corner joint, where each locking member 16*a*', 16'*b* has insertion portions 54 sized to extend through only three of the six total levels of corrugations 34, 66 to be positioned inside the brackets 14. In a related embodiment, a single locking member 16' could be used in each bracket 14, where the locking member 16' has an insertion portions 54 sized to extend through all six levels of the corrugations 34, 66 (i.e. to simultaneously extend through the keyways A, C of both wall members 12*a*, 12*b* and both corner members 60*a*, 60*b*). According to these principles, containment systems 10 of any size may be constructed by forming brackets 14 of the required size, and then providing and stacking multiple iterations of the other components as necessary to complete the system 10.

Figure 21:
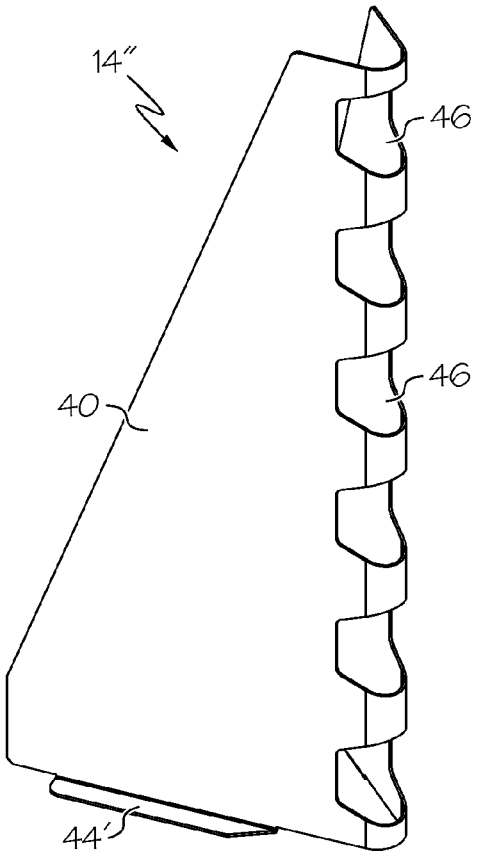
FIG. 21 is a isometric view of another embodiment of a primary bracket.
Figure 22:
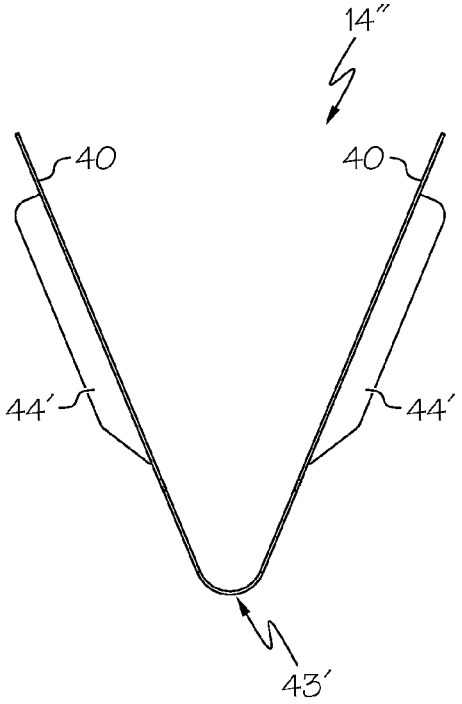
FIG. 22 is a top plan view of the primary bracket of FIG. 21.
Figure 23:
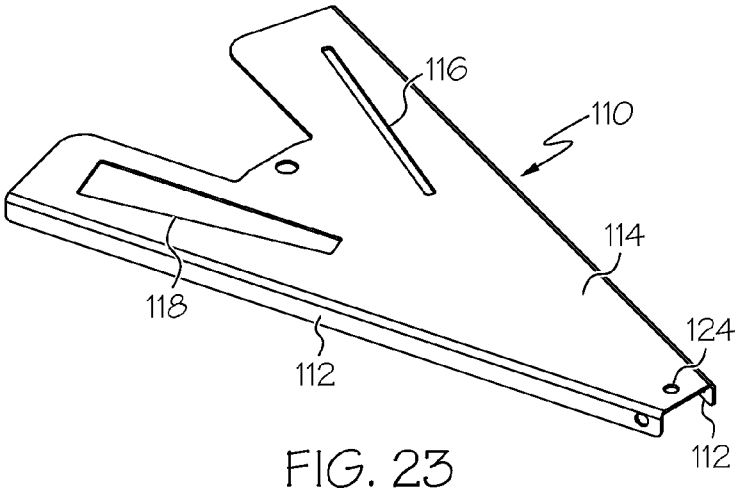
FIG. 23 is an isometric view of a base pad member used to support the primary bracket of FIG. 21.
Figure 24:
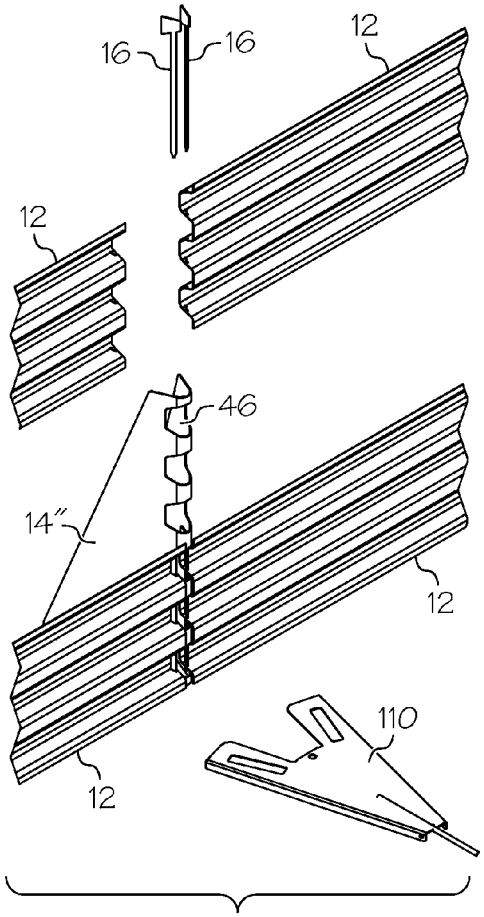
FIG. 24 is an isometric, partially exploded view of a primary bracket, base pad member and associated corrugated wall members.

Referring now to FIGS. 21-26, another containment system embodiment is shown that employs corner brackets 78" (per FIGS. 19 and 20), primary brackets 14" of the type shown in FIGS. 21 and 22 and base pad members 110 of the type shown in FIG. 23. The primary bracket 14" includes outwardly extending base portions 44' at the bottom of each panel 40 as shown, with panels 40 connected by and diverging from a curved joint 43'. The base portions 44' are offset vertically slightly below the lower edges of the panels. The primary bracket 44' may be formed by cutting flat metal sheet to desired profile (with openings 46 formed therein and extensions 44') and then bending the sheet into the illustrated shape. Assembly of the wall members 12 with the primary bracket 14" is achieved in the same manner as previously described above with respect to other embodiments, using the elongated locking members or keys 16 to engage upright keyways formed by the aligned openings in the corrugations of the wall members 12.

The base pad member 110 includes a base surface 114 and downwardly extending side support flanges 112 that provide a spacing between the surface 114 and the ground on which the base pad member sits. The base pad member 110 may be formed by cutting flat metal sheet to desired profile (with openings 116, 118 and 124 formed therein) and then bending the sheet into the illustrated shape. The base surface 114 includes a pair of openings 116 and 118 that are configured to receive the base portions 44' of the primary bracket 14" when the primary bracket 14" is seated on the base pad member 110 with the bottom edges of the upright panels 40 atop the base surface 114. The openings 116 and 118 are elongated slots for this purpose, with slot 118 being wider than slot 116, which facilitates positioning of the primary bracket 14" on the base pad member 110. In particular, the primary bracket 14" can be turned horizontally so that the base portion 44' of one panel 40 can be inserted into slot 16, and the primary bracket 14" is then pivoted back to an upright orientation so that the base portion 44' of the other panel 40 passes downward through opening 118. The engagement of the one base portion 44' and narrower slot 116 provides a connection that prevents the primary bracket 14" from being separated from the base pad member by a simple vertical motion. The engagement between the primary bracket 14" and the base pad member 110 also prevents the primary bracket 14" and the base pad member from sliding laterally relative to each other.

Figure 25:
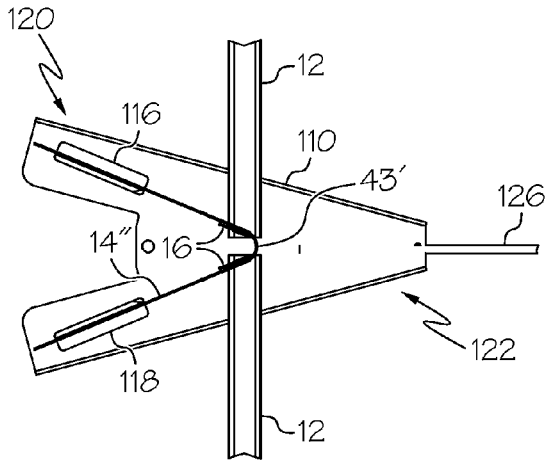
FIG. 25 is a top plan view of an assembled primary bracket, base pad member and associated corrugated wall members.
Figure 26:
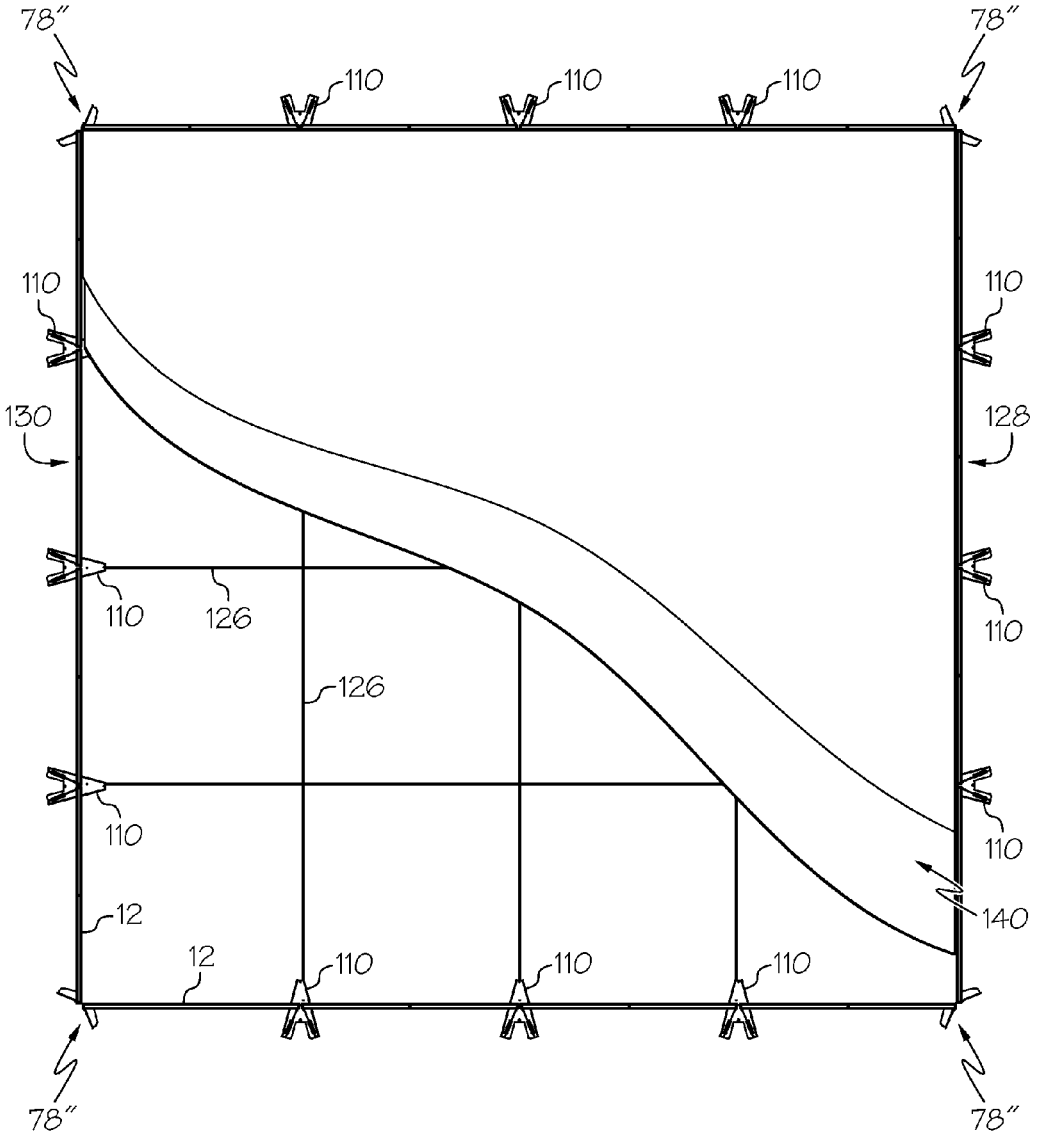
FIG. 26 is a top plan view of an exemplary containment system.
Figure 27:
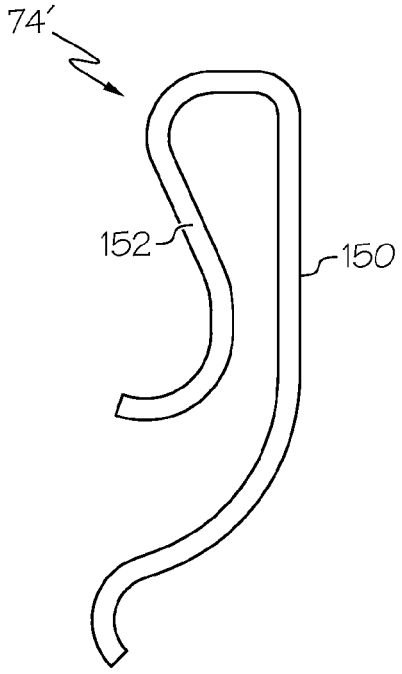
FIG. 27 is a side profile view of another embodiment of a top edge cap member.
Figure 28:
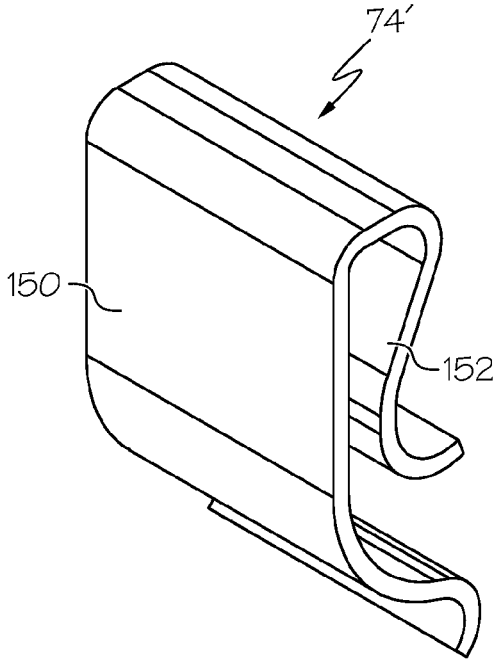
FIG. 28 is an isometric view of a portion of the cap member of FIG. 27.

As seen in FIG. 25, when the primary bracket 14" is seated on the base pad member 110, the base pad member 110 includes one portion 120 that is located to one side of the primary bracket joint 43' (i.e., the side external of the containment boundary) and one portion 122 that is located to the opposite side of the primary bracket joint 43' (i.e., the side internal of the containment boundary). Base pad portion 122 includes an opening to which a support cable 126 is attached when the containment system is assembled. As seen in the top plan view of a containment system 128 shown in FIG. 26, the cable extends to another base pad member (with its own associated primary bracket 14" thereon) located on an opposite side of the containment boundary 130. As suggested in FIG. 26, the cabling 126 within the area of the containment boundary, as well as inner portions 122 of the base pad members, may be covered by a liner arrangement 140 (shown partially broken away in FIG. 26). As previously indicated, the liner arrangement 140 may include an impermeable material (such as impermeable geotextile) that is laid (e.g., directly on the ground surface or over a bed of gravel or sand) within the containment boundary 130 and that extends upward to the tops of the wall members 12 forming the boundary, with an edge cap fitted over the tops of the boundary walls to help hold the liner in place. FIGS. 27 and 28 show another embodiment of an edge cap 74' that may be used for this purpose, where the edge cap 74' includes an inner leg 150 and an outer leg 152, where the inner leg is longer than the outer. The edge cap may be formed of an extruded aluminum that provides for some resilience between the inner leg 150 and the outer leg 152, enabling the cap member to slide downward over the top of the corrugated wall members, with the curvature in the leg members designed to engage tightly with the corrugation configuration so as to hold the liner member tightly in place.

The embodiments of this invention shown in the drawings and described above are exemplary of numerous embodiments that may be made within the scope of the appended claims. It is contemplated that numerous other configurations of the containment system may be created taking advantage of the disclosed approach. In short, it is the applicant's intention that the scope of the patent issuing herefrom be limited only by the scope of the appended claims.

What is claimed is:

1. A containment system comprising:

a wall member including a plurality of corrugations, each corrugation extending horizontally along a length of the wall member, each of a multiplicity of the corrugations having openings therein, wherein at least some of the openings in the corrugations at least partially align to form an upright keyway through the wall member;

a bracket having a plurality of corrugation-receiving spaces therein, the wall member positioned with corrugations in respective corrugation-receiving spaces, wherein the bracket includes a first upright support panel and a second upright support panel angularly connected along a joint, the plurality of corrugation-receiving spaces formed by stepped notches in respective end portions of each of the first upright support panel and second upright support panel along the joint;

a base pad member formed separately from the bracket and upon which the bracket sits; and a locking member received in the upright keyway of the wall member and positioned such that interaction between the locking member and portions of the bracket prevent the wall member from being pulled away from the bracket.

2. The containment system of claim 1, wherein the first upright support panel and the second upright support panel of the bracket are formed of a single sheet of material that is bent into shape.

3. The containment system of claim 1 wherein:

the first upright support panel includes a lower base portion, the second upright support panel includes a lower base portion, the base pad member includes a base surface portion upon which a lower edge of the first upright support panel and a lower edge of the second upright support panel sit, the base surface portion includes a first opening through which the lower base portion of the first upright support panel extends and a second opening through which the lower base portion of the second upright support panel extends.

4. The containment system of claim 3 wherein:

the base pad member includes a first portion to a first side of the joint, a second portion to a second side of the joint, wherein the first upright panel and the second upright panel are located on the first portion of the base pad member, and the second portion of the base pad member is connected to a cable member that extends to another base pad member located on an opposite side of the containment system.

5. The containment system of claim 1, wherein the upright keyway through the wall member extends through all of the corrugations of the wall member and the locking member extends through a full height of the upright keyway.

6. The containment system of claim 1, wherein the plurality of openings defining the keyway are narrow slits.

7. The containment system of claim 1, wherein the first and second upright support panels are triangular in shape.

8. The containment system of claim 1, further comprising an edge cap attached to a top edge of the wall member, wherein a portion of the cap is positioned between the wall member and the bracket, wherein an upper portion of a containment system liner is captured between the wall member and the edge cap.

9. The containment system of claim 1, wherein the locking member is slidably received in the keyway.

10. The containment system of claim 1, wherein the bracket has a first side and a second side, the wall member positioned to the first side of the bracket, a portion of each of the corrugations in the corrugation receiving spaces extends through the bracket to the second side of the bracket to locate the upright keyway to the second side of the bracket, the locking member positioned to the second side of the bracket.

11. The containment system of claim 1, further comprising:

a second wall member including a plurality of second corrugations, each second corrugation extending horizontally along a length of the second wall member, each of a multiplicity of the second corrugations having openings therein, wherein at least some of the openings in the second corrugations at least partially align to form an upright keyway through the second wall member, wherein the second wall member is positioned within the corrugation-receiving spaces of the bracket; and a second locking member received in the upright keyway of the second wall member and positioned such that interaction between the second locking member and portions of the bracket prevent the second wall member from being pulled away from the bracket.

12. The containment system of claim 11, wherein the wall member and the second wall member are positioned end-to-end with abutting corrugation ends in the corrugation-receiving spaces of the bracket.

13. The containment system of claim 11, wherein the wall member and the second wall member are positioned vertically atop each other.

14. A containment system, comprising:

a plurality of elongated corrugated wall members, each having corrugations extending laterally along a length of the wall member, the plurality of wall members assembled into a containment boundary utilizing a plurality of brackets, each bracket having a plurality of corrugation-receiving spaces therein with at least one wall member of the plurality positioned with its corrugations in the corrugation-receiving spaces of the bracket and held in place relative to the bracket by an elongated locking key that is inserted through a keyway formed in the corrugations of the wall member and each bracket including first and second panels, each panel including a lower base portion;

a plurality of base pad members, wherein a multiplicity of the brackets are each seated on a base surface of a respective base pad member, wherein the base surface includes a first opening through which the lower base portion of the first panel extends and a second opening through which the lower base portion of the second panel extends.

15. The containment system of claim 14 wherein:

wherein the first and second panels of each bracket diverge from a joint region where the corrugation receiving spaces are located;

each base pad member includes a first portion to a first side of the joint region, a second portion to a second side of the joint region, wherein, as to the bracket seated on each base pad member, the first panel and the second panel are located on the first portion of the base pad member, and the second portion of the base pad member is connected to a cable member that extends to another base pad member located on an opposite side of the containment boundary.

16. The containment system of claim 14 further comprising:

each bracket is a primary bracket the first and second panels diverge from a joint region where the corrugation receiving spaces are located, wherein the corrugation-receiving spaces of each primary bracket are fully open across the joint region;

a plurality of corner brackets are used to angularly join wall members at corners of the containment boundary, each corner bracket includes a plurality of corrugation receiving spaces and first and second panels that diverge from a joint region where the corrugation receiving spaces are located, wherein the corrugation receiving spaces of the corner brackets are formed by spaced apart slots configured to slidingly receive corrugations of the wall members.

17. A containment system, comprising:

a plurality of elongated corrugated wall members, each having corrugations extending laterally along a length of the wall member, the plurality of wall members assembled into a containment boundary utilizing a plurality of brackets, each bracket having a plurality of corrugation-receiving spaces therein with at least one wall member of the plurality positioned with its corrugations in the corrugation-receiving spaces of the bracket and held in place relative to the bracket by an elongated locking key that is inserted through a keyway formed in the corrugations of the wall member;

each bracket including first and second panels that diverge from a joint region where the corrugation receiving spaces are located;

a plurality of base pad members, wherein a multiplicity of the brackets are each seated on a respective base pad member, each base pad member includes a first portion to a first side of the joint region, a second portion to a second side of the joint region, wherein, as to the bracket seated on each base pad member, the first panel and the second panel are located on the first portion of the base pad member, and the second portion of the base pad member extends within an area bounded by the containment boundary and is connected to a cable member that extends to another base pad member located on an opposite side of the containment boundary.

* * * * *